US006991609B2

(12) United States Patent
Kan et al.

(10) Patent No.: US 6,991,609 B2
(45) Date of Patent: Jan. 31, 2006

(54) MASSAGE ASSEMBLY AND MASSAGE MACHINE INCORPORATING SAME

(75) Inventors: Yuji Kan, Kasai (JP); Nobuaki Takahashi, Kasai (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 84 days.

(21) Appl. No.: 10/326,382

(22) Filed: Dec. 23, 2002

(65) Prior Publication Data

US 2003/0120187 A1 Jun. 26, 2003

(30) Foreign Application Priority Data

Dec. 26, 2001 (JP) ..... 2001-393367

(51) Int. Cl.
*A61H 15/00* (2006.01)

(52) U.S. Cl. ..... 601/99; 601/100; 601/102; 601/103; 601/116

(58) Field of Classification Search ..... 601/84, 601/89–90, 91–94, 97–99, 100–103, 115, 601/116, 134
See application file for complete search history.

(56) References Cited

U.S. PATENT DOCUMENTS

| | | | | |
|---|---|---|---|---|
| 4,422,449 | A * | 12/1983 | Hamabe | 601/99 |
| 4,574,786 | A * | 3/1986 | Hashimoto et al. | 601/99 |
| 4,576,149 | A * | 3/1986 | Otuka et al. | 601/99 |
| 4,686,967 | A | 8/1987 | Hashimoto et al. | 128/57 |
| 4,718,408 | A * | 1/1988 | Barreiro | 601/99 |
| 5,179,940 | A * | 1/1993 | Barreiro | 601/99 |
| 5,464,382 | A * | 11/1995 | Wang | 601/99 |
| 5,630,790 | A * | 5/1997 | Ito | 601/94 |
| 5,792,080 | A | 8/1998 | Ookawa et al. | 601/115 |
| 6,283,928 | B1 | 9/2001 | Wang | 601/99 |
| 6,402,709 | B1 | 6/2002 | Wu | 601/98 |

FOREIGN PATENT DOCUMENTS

| | | |
|---|---|---|
| DE | 200 11 920 | 11/2000 |
| EP | 1 145 701 | 10/2001 |

OTHER PUBLICATIONS

European Search Report dated Jun. 10, 2003.

* cited by examiner

*Primary Examiner*—Danton D. DeMille
*Assistant Examiner*—Quang D. Thanh
(74) *Attorney, Agent, or Firm*—Armstrong, Kratz, Quintos, Hanson & Brooks, LLP

(57) ABSTRACT

A massage assembly (20) wherein a massage unit (40) comprising a therapeutic member (50) for massaging the body of the user by a kneading and/or tapping movement is reciprocatingly moved between a pair of frames (22) (23) and which comprises a motion converting mechanism for converting the reciprocating movement of the massage unit (40) to the kneading and/or tapping movement of the therapeutic member (50). The massage assembly (20) is incorporated in a backrest (16) of a chair (12) or a bed to provide a massage machine (10) of the invention.

7 Claims, 4 Drawing Sheets

MASSAGE ASSEMBLY AND MASSAGE MACHINE INCORPORATING SAME

FIELD OF THE INVENTION

The present invention relates to a massage assembly for massaging the shoulders, back and/or waist of the user, and more particularly to a massage assembly for converting a reciprocating movement of a massage unit to the movement of therapeutic members, and to a massage machine having the assembly incorporated therein.

BACKGROUND OF THE INVENTION

Massage machines are available which have therapeutic members movable upward and downward, leftward and rightward and/or forward and backward for massaging the shoulders, back and waist of the user. Such a massage machine includes a massage assembly comprising a massage unit provided with therapeutic members and reciprocatingly movable. The massage assembly is incorporated in the backrest of a chair or a bed.

The massage assembly is equipped with a power source for reciprocatingly moving the massage unit and another power source for moving the therapeutic members. The massage machine therefore has the problem of being large-sized and heavy-weighted.

Further massage machines are available wherein a motor for moving the therapeutic members is mounted on the massage unit. In the case where massage machines of the chair type have this construction, the center of gravity of the machine shifts upward when the massage unit, which is given an increased weight by the motor mounted thereon, moves upward. This entails the problem of impairing the stability of the chair.

An object of the present invention is to provide a massage assembly wherein the reciprocating movement of a massage unit is converted to the movement of therapeutic members and which is provided with a single motor for moving the massage unit and the therapeutic members and is thereby made lightweight, compacted and simplified in construction, and a massage machine having the massage assembly incorporated therein.

SUMMARY OF THE INVENTION

To fulfill the above object, the present invention provides a massage assembly wherein a massage unit comprising a therapeutic member for massaging the body of the user by a massaging action capable of producing a kneading and/or a tapping movement wherein the therapeutic member is reciprocatingly moved between a pair of frames and which comprises a motion converting mechanism for converting a reciprocating movement of the massage unit to a kneading and/or tapping movement of the therapeutic member. As used herein the term, "massaging action", shall mean such action as will selectively produce a kneading movement, a tapping movement, or a combination of such movements.

The present invention also provides a massage machine comprising the massage assembly as incorporated in a backrest of a chair or bed.

The massage assembly of the invention moves the therapeutic member by converting the reciprocating movement of the massage unit to this movement. Accordingly, a single motor for reciprocatingly moving the massage unit serves as the sole drive source. The massage unit need not be provided with another motor for moving the therapeutic member, nor is it necessary to provide, for example, electric wiring for this motor. This renders the massage unit and the massage assembly compact and lightweight, further resulting in decreased operation noise and reduced power consumption.

Since the massage assembly can be compacted and made lightweight, the backrest of the chair or bed of the massage machine can be reduced in thickness to render the massage machine also lightweight.

DETAILED DESCRIPTION OF THE PREFERRED EMBODIMENT

The present invention will be described below with reference to a massage machine of the chair type to which the invention is applied. The invention is applicable not only to the chair type but also to massage machines of the bed type. In the following description, the term "upper" refers to the direction toward which the shoulders are positioned when the user is seated in the chair, and the term "lower" to the direction toward which the waist of the seated user is positioned.

Figure 1:
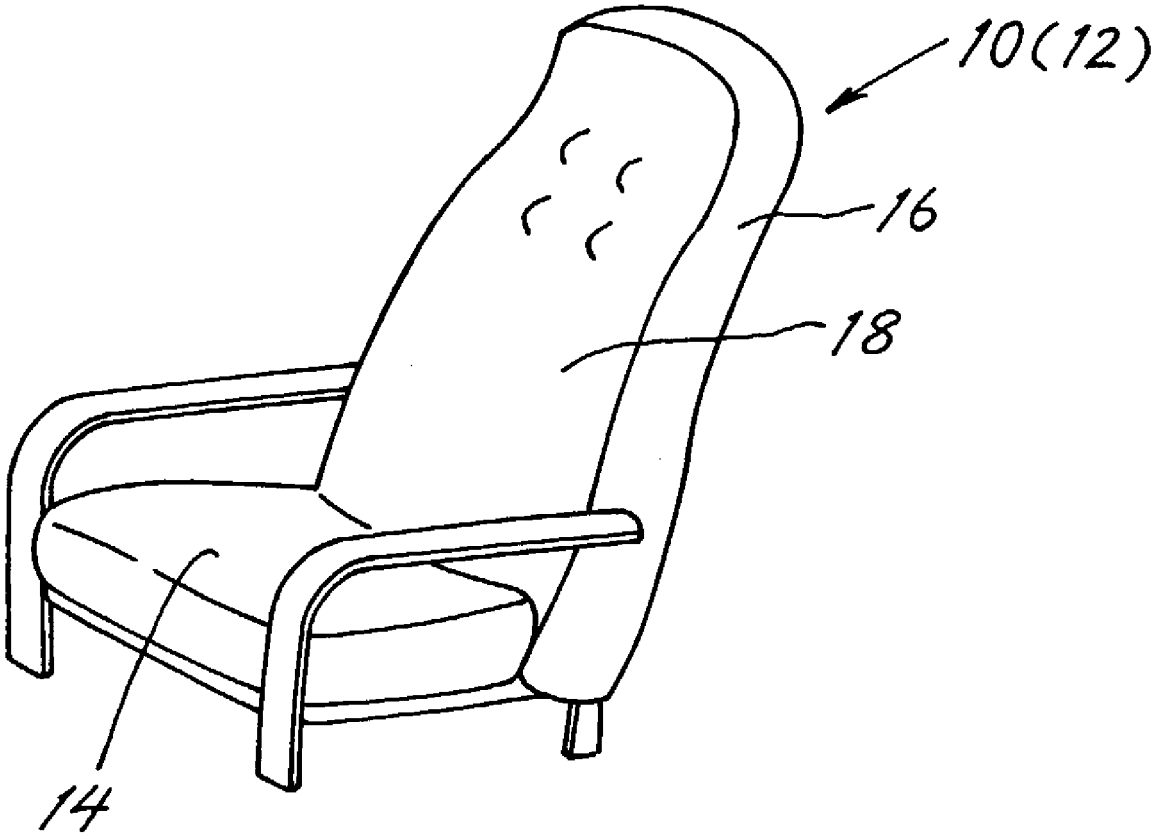
FIG. 1 is a perspective view of a massage machine of the chair type.

FIG. 1 is a perspective view of a massage machine 10 of the chair type. A chair 12 comprises a seat 14 for the user to sit in, and a backrest 16 extending upward from the rear end of the seat 14. The backrest 16 may be made tiltable relative to the seat 14.

The backrest 16 is enclosed with a fabric or like cover 18. The cover 18 has disposed therein a massage assembly 20 of the invention.

Figure 2:
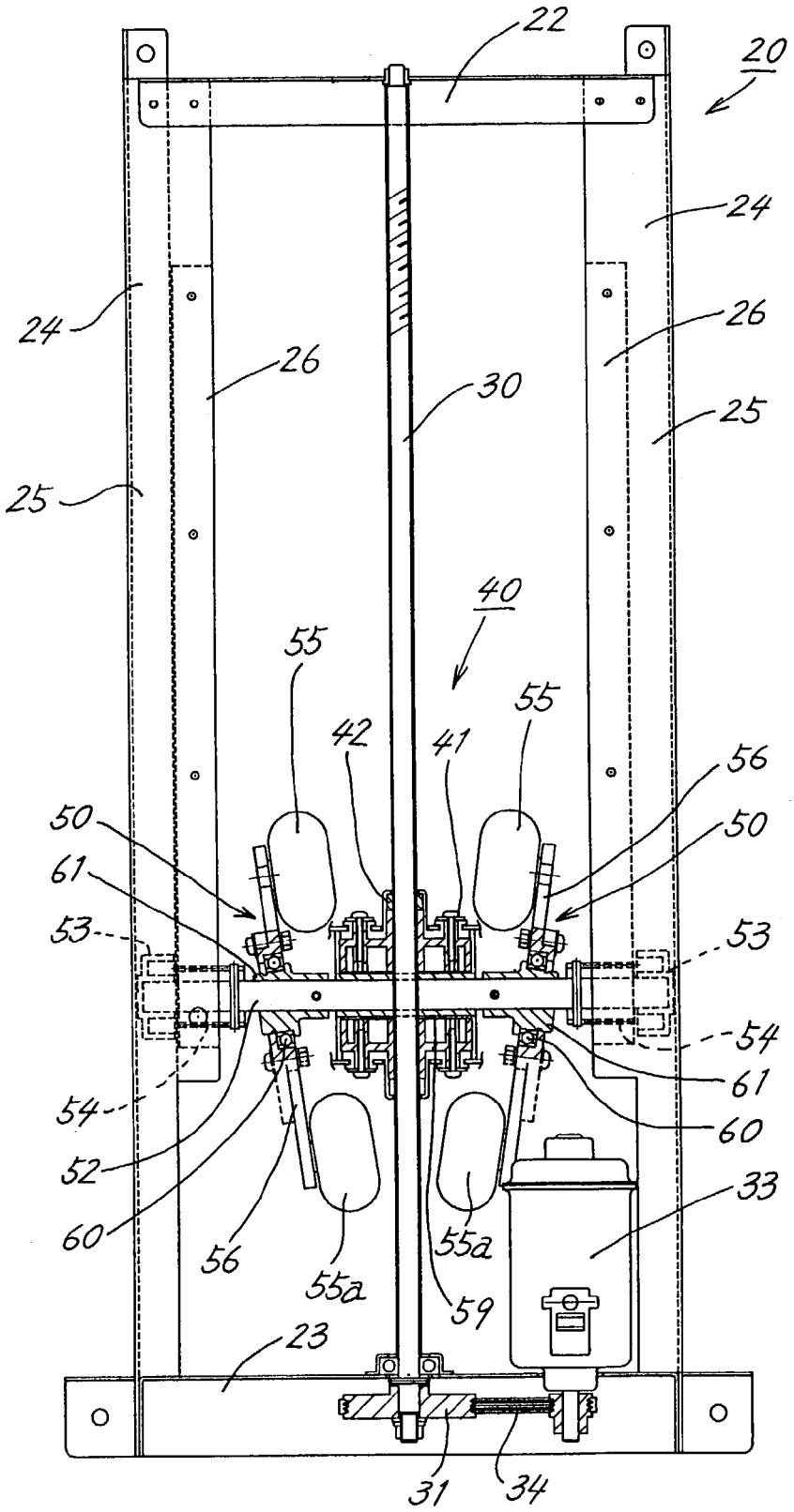
FIG. 2 is a rear view partly in section and showing a massage assembly of the invention.

As shown in FIG. 2, the massage assembly 20 comprises upper and lower frames 22, 23, and guide rails 24, 24 interconnecting these frames. The frames 22, 23 and/or guide rails 24, 24 are attached, for example, to the frame of the backrest 16.

Figure 3:
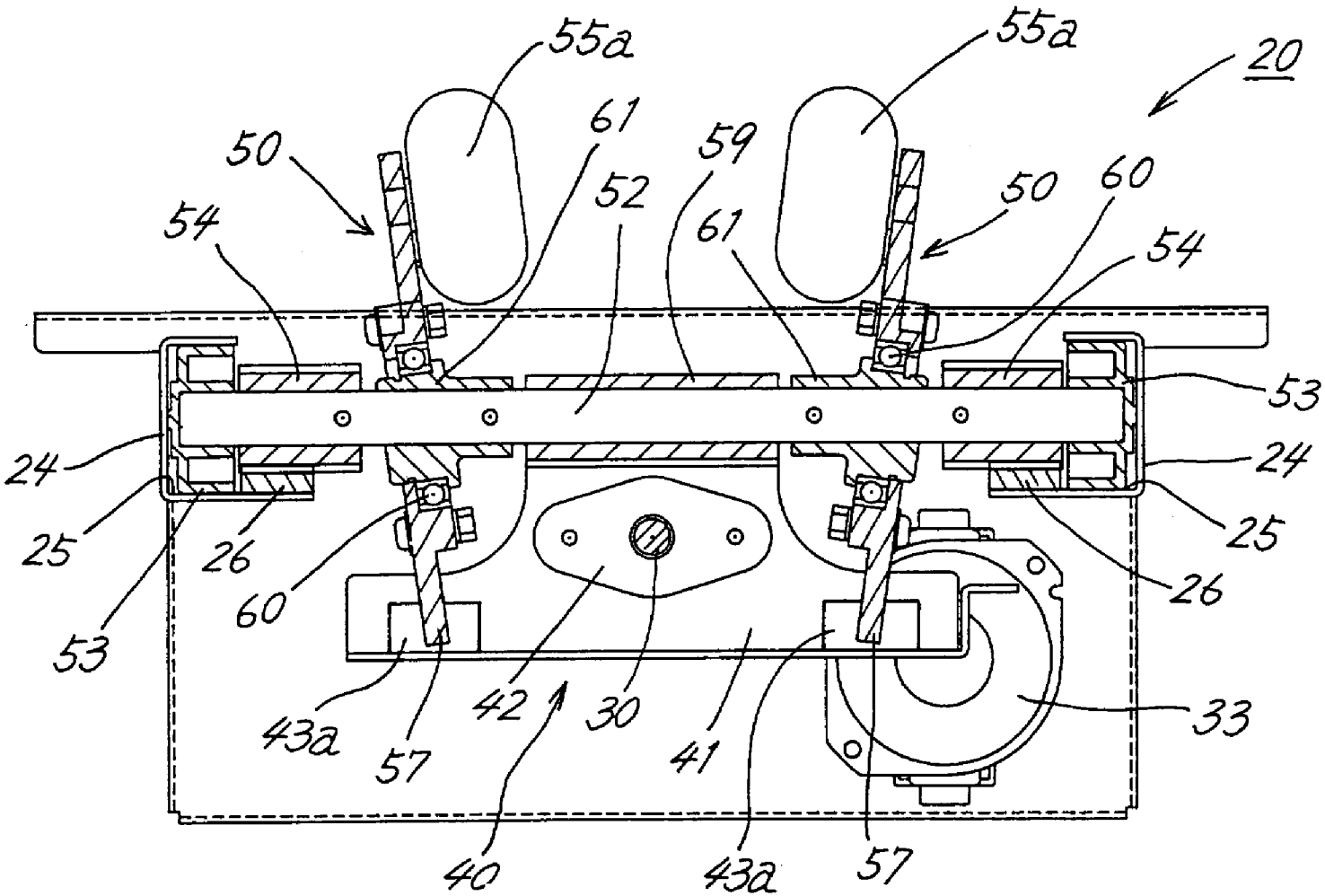
FIG. 3 is a view in section along a therapeutic shaft of the massage assembly of the invention.

The guide rails 24, 24 comprise channel-shaped rail portions 25, 25, which are attached to the frames 22, 23, with their recesses facing inward toward each other as shown in FIG. 3.

Each rail portion 25 is provided on the inner side thereof with a rack 26, which is preferably made of a resin so as to ensure reduced operation noise.

Disposed between the guide rails 24, 24 is a screw rod 30 extending through and supported by the upper and lower frames 22, 23. The screw rod 30 has a pulley 31 mounted on its lower end and connected by a belt 34 to a motor 33 fixed to the lower frame 23 for power transmission. The motor 33 is mounted on the lower frame 23 to thereby lower the center of gravity of the assembly 20 and give good stability to the chair 12.

When driven, the motor 33 rotates the screw rod 30 positively or reversely. The expression "positive rotation" means the rotation in such a direction as to move a massage unit 40 to be described below upward, and the expression "reverse rotation" means the rotation in such a direction as to move the massage unit 40 downward.

Figure 4:
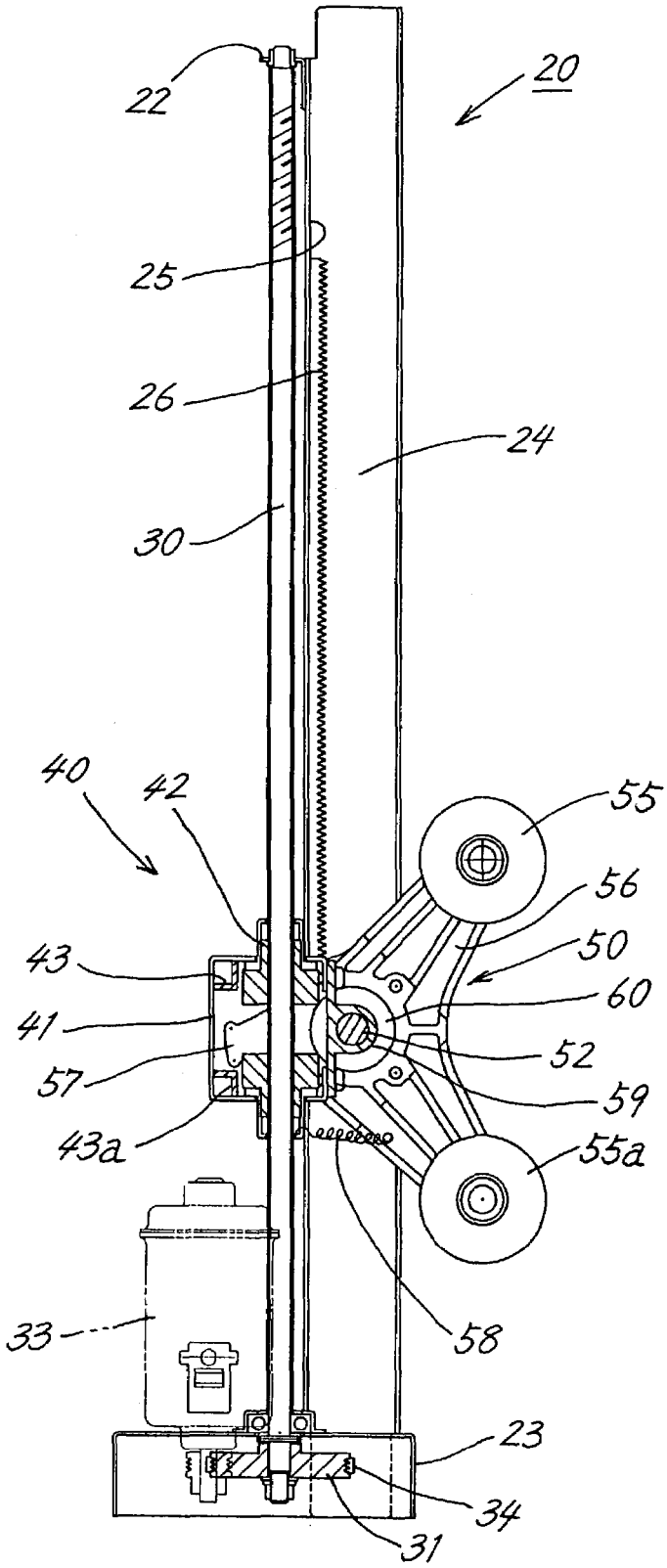
FIG. 4 is a view in section along a screw rod of the massage assembly of the invention.

With reference to FIGS. 2 to 4, the massage unit 40 is reciprocatingly movably disposed between the upper and lower frames 22, 23. The massage unit 40 comprises therapeutic members 50, 50 arranged on a base plate 41. The base plate 41 is a box having an open front side and centrally provided with threaded sleeves 42, 42 screwed on the screw rod 30. The base plate 41 is provided with a therapeutic shaft 52 orthogonal to the screw rod 30. The therapeutic members 50, 50 at left and right are mounted on the therapeutic shaft 52 and spaced apart from each other by a predetermined distance. The therapeutic shaft 52 is rotatably supported by a shaft bearing plate 59 supported by upper and lower portions of the base plate 41 and positioned centrally of the front opening thereof. The shaft 52 carries at opposite ends thereof rollers 53 fitting in the respective rail portions 25 of the guide rails 24. The rollers 53 are preferably made of a resin.

Pinions 54 meshing with the respective racks 26 are fixed to the therapeutic shaft 52 rotatably therewith and positioned closer to the center of the assembly 20 than the rollers 53 to provide a motion converting mechanism. Preferably, the pinions 54 are made of a resin to ensure reduced operation noise.

Preferably, the rollers 53 and the pinions 54 are so adapted that even when the massage unit 40 is pushed rearward by the user, the force acts on the rollers 53, with a clearance maintained between each pinion 54 and the rack 26. This reduces the friction to be produced between the rack 26 and the pinion 54 to diminish the wear on these members and reduce the operation noise.

When the screw rod 30 is rotated positively or reversely, the threaded sleeves 42 are moved upward or downward by screw thrust to reciprocatingly move the base plate 41 coupled to the threaded sleeves 42. Since the therapeutic shaft 52 has its opposite ends held in meshing engagement with the racks 26 by the respective pinions 54, the shaft 52 rotates when the pinions 54 travel on the racks 26 while in rotation with the reciprocating movement of the base plate 41.

The therapeutic shaft 52 has the therapeutic members 50, 50 mounted thereon as seen in FIGS. 2 to 4. The therapeutic members 50, 50 each comprise an arm 56 extending upward or downward as bent at an obtuse angle at its midportion, and kneading balls 55, 55*a* rotatably mounted on respective opposite ends of the arm 56 as shown in FIG. 4. By an attaching member 61 fixedly fitted around the shaft 52, a support bearing 60 is mounted on the bent portion of the arm 56, with the center of rotation of the bearing 60 inclined with respect to the shaft 52 and positioned eccentrically thereof. Each of the members 50, 50 is supported by the bearing 60 on the shaft 52, as inclined with respect to the shaft.

As shown in FIGS. 3 and 4, each member 50 has a contact piece 57 projecting rearward from the rear end thereof. The rear wall of the base plate 41 has upper and lower stoppers 43, 43*a* projecting therefrom toward a path of movement of the contact piece 57 for limiting the angle of pivotal movement of the therapeutic member 50.

The arm 56 is provided below the bent portion thereof with means 58 for biasing the arm 56 rearward. The illustrated biasing means 58 is a coil spring and extends between, and is attached to, the arm 56 and the base plate 41 for biasing the lower portion of the arm 56 rearward so that the upper kneading ball 55 will project forward.

When free of load, each therapeutic member 50 is in a standby state, with its contact piece 57 held in bearing contact with the upper stopper 43 by the biasing means 58 and with the upper kneading ball 55 projecting forward.

When the therapeutic shaft 52 is rotated, the therapeutic members 50, 50 act to rotate with the shaft 52 following the rotation thereof, whereas because each member 50 has its lower portion biased rearward by the biasing means 58 and because the angle of pivotal movement of the member is limited by the stoppers 43, 43*a*, the member 50 moves up and down within the range limited by the contact of the piece 57 with the stoppers 43, 43*a* while pivotally moving leftward and rightward without following the shaft 52.

The massage assembly 20 is disposed within the backrest 16 of the chair 12 shown in FIG. 1, with the screw rod 30 positioned in parallel to the longitudinal direction of the backrest 16, and the cover 18 is provided over the backrest.

The operation of the massage machine 10 thus constructed will be described.

When the motor 33 is driven with the user seated in the chair 12, the screw rod 30 rotates. The threaded sleeves 42 of the massage unit 40 are in screw-thread engagement with the screw rod 30, so that when the screw rod 30 rotates positively, the massage unit 40 is moved upward by the resulting screw thrust. When the screw rod 30 is rotated reversely, the unit 40 is moved down.

The reciprocating movement of the massage unit 40 causes the pinions 54, 54 on the therapeutic shaft 52 to travel on the racks 26, 26 while in rotation. The rotation of the pinions 54, 54 rotates the shaft 52.

The rotation of the therapeutic shaft 52 moves the therapeutic members 50, 50 while pivotally moving the members leftward and rightward, whereby the user can be massaged by kneading in combination with a rolling massage afforded by the reciprocating movement of the massage unit 40.

With the massage assembly 20 of the invention and the massage machine 10 incorporating the assembly, the reciprocating movement of the massage unit 40 can be converted to the reciprocating movement of the therapeutic members 50, 50. This eliminates the need to provide another drive source for moving the members 50, 50.

Further with the massage assembly 20 of the foregoing construction, the massage unit 40 or the kneading balls 55, 55*a* are likely to be forcibly pushed rearward by the user during massaging, whereas the force acts on the rollers 53 bearing on the guide rails 24, with a predetermined clearance maintained between each pinion 54 and the rack 26. Even if the pinion 54 and the rack 26 are made of a resin, a great frictional force will not be produced therebetween, with wear on the teeth and occurrence of noise precluded.

Although the screw rod 30 is used for reciprocatingly moving the massage unit 40, the screw rod 30 can be replaced by a chain reeved around the upper and lower frames 22, 23 and movable by the rotation of a motor, with a massage unit attached to the chain, so that the massage unit 40 is reciprocatingly movable by the travel of the chain.

The foregoing embodiment is adapted to perform a kneading massage as described above, whereas the massage assembly can be adapted to perform a tapping massage or the combination of a kneading massage and a tapping massage by reciprocatingly moving the therapeutic members 50, 50 upward and downward.

Apparently, the present invention can be modified or altered by one skilled in the art without departing from the spirit of the invention. Such modifications are included within the scope of the invention as set forth in the appended claims.

What is claimed is:

1. A massage assembly comprising:

a stationary frame structure including a pair of frames, a massage unit reciprocatingly movable between said pair of frames, the massage unit having a therapeutic member for massaging the body of a user by a massage action including a kneading movement, a drive mechanism for imparting reciprocating movement to the massage unit, said drive mechanism including a motor fixedly attached to said frame structure and a single drive member connecting between said motor and said massage unit and being operative to move said massage unit in alternate directions upon operation of said motor, and said massage unit including a motion converting mechanism driven by the reciprocating movement of the massage unit and being operative for moving the therapeutic member, so that the reciprocating movement of the massage unit with respect to said frame structure by the single drive member is converted to the massage action of the therapeutic member.

2. The massage assembly according to claim 1 in which the drive mechanism comprises a single drive member defined by a screw rod disposed between the frames and extending parallel to the direction of reciprocating movement of the massage unit along said frames, and a threaded sleeve carried by the massage unit and being in screw-thread engagement with the screw rod, the massage unit being reciprocatingly movable between the frames by the rotation of the screw rod.

3. A massage machine characterized in that a massage assembly according to claim 1 is incorporated in a backrest of a chair or a bed.

4. A massage assembly comprising:

a massage unit having a therapeutic member for massaging the body of the user by a massage action including a kneading movement, while being reciprocatingly moved between a pair of frames:

a screw rod disposed between the frames and parallel to the direction of reciprocating movement of the massage unit, a motor for rotating the screw rod, and a threaded sleeve in screw-thread engagement with the screw rod and provided on the massage unit, the massage unit being reciprocatingly movable between the frames by the rotation of the screw rod, and a motion converting mechanism for converting the reciprocating movement of the massage unit to the massage action of the therapeutic member, the motion converting mechanism comprising a rack extending between the frames, and a pinion coupled to the therapeutic member and meshing with the rack, the pinion being travelable on the rack with the reciprocating movement of the massage unit to move the therapeutic member by the rotation of the pinion.

5. The massage assembly according to claim 4, wherein the therapeutic member is supported by a therapeutic shaft disposed orthogonal to the screw rod, and the pinion is coupled to the therapeutic shaft, the therapeutic shaft being rotatable by the rotation of the pinion to move the therapeutic member.

6. The massage assembly according to claim 4 wherein a pair of guide rails are provided between the frames in parallel to the screw rod, with the screw rod positioned between the guide rails, and the therapeutic shaft is provided at opposite ends thereof with rollers fitting to the respective guide rails.

7. The massage assembly according to claim 4 wherein the pinion and the rack are made of a resin.

* * * * *